US006192881B1

(12) United States Patent
Nix

(10) Patent No.: US 6,192,881 B1
(45) Date of Patent: Feb. 27, 2001

(54) PORTABLE FIREPLACE

(76) Inventor: Ronald Scott Nix, 1821 Boston Ave., Longmont, CO (US) 80501

( * ) Notice: Subject to any disclaimer, the term of this patent is extended or adjusted under 35 U.S.C. 154(b) by 0 days.

(21) Appl. No.: 09/224,235

(22) Filed: Dec. 30, 1998

(51) Int. Cl.[7] ..... F24C 3/04; F24C 15/06; F24C 15/08

(52) U.S. Cl. ..... 126/512; 431/125; 431/202; 431/126; 126/85 R; 126/39 R; 126/503

(58) Field of Search ..... 431/202, 125, 431/126; 126/512, 203, 41 R, 25 R, 39 R, 85 R; 239/18, 20; 362/101; 434/226

(56) References Cited

U.S. PATENT DOCUMENTS

| | | | | |
|---|---|---|---|---|
| 1,101,721 | * | 6/1914 | Van Hoesen . | |
| 3,038,064 | * | 6/1962 | Gieb . | |
| 3,410,261 | | 11/1968 | Cooper et al. | 126/25 |
| 3,565,337 | * | 2/1971 | Ditto . | |
| 3,830,217 | * | 8/1974 | Maness et al. | 239/18 |
| 3,892,519 | * | 7/1975 | Reed et al. | 431/202 |
| 4,108,142 | | 8/1978 | Barson et al. | 126/41 |
| 4,553,524 | | 11/1985 | Wheat et al. | 126/25 |
| 4,705,020 | | 11/1987 | Hahn | 126/41 |
| 4,721,037 | * | 1/1988 | Blosnich | 126/41 R |
| 4,788,962 | | 12/1988 | Mashburn et al. | 126/25 |
| 4,858,826 | * | 8/1989 | Robinson et al. | 239/18 |
| 4,903,683 | | 2/1990 | Larsen et al. | 126/25 |
| 5,094,223 | | 3/1992 | Gonzalez | 126/25 |
| 5,203,317 | | 4/1993 | James | 126/41 |
| 5,320,520 | * | 6/1994 | Barth et al. | 431/125 |
| 5,374,191 | * | 12/1994 | Herman et al. | 434/226 |
| 5,413,087 | | 5/1995 | Jean | 126/41 |
| 5,575,195 | * | 11/1996 | Foxford | 126/25 R |
| 5,655,435 | * | 8/1997 | Rachesky | 126/25 R |
| 5,700,142 | * | 12/1997 | Miller et al. | 431/125 |
| 5,738,084 | * | 4/1998 | Hussong | 126/512 |

FOREIGN PATENT DOCUMENTS

| | | | | |
|---|---|---|---|---|
| 2331802 | * | 2/1999 | (GB) | 126/512 |
| 2-75827 | * | 2/1990 | (JP) | 126/512 |

* cited by examiner

*Primary Examiner*—Carl D Price
(74) *Attorney, Agent, or Firm*—Rick Martin; Patent Law Offices of Rick Martin, P.C.

(57) ABSTRACT

The invention comprises a portable open flame fireplace. The invention has a planar base with a plurality of gas orifices. The base is of any desired shape. The gas is directed through channels in the base to the orifices, where it emerges and ignites. In an alternate embodiment, the base is enclosed with a watertight windscreen above the base. The windscreen may also contain water, which allows the illusion of flames emerging from a free water surface. The invention further comprises a detachable portable fuel source, such as a propane gas bottle. The invention also has a removable cover for storage and transport.

15 Claims, 3 Drawing Sheets

PORTABLE FIREPLACE

FIELD OF THE INVENTION

The present invention relates to fireplaces, more particularly, to portable outdoor fireplaces having a detachable gas fuel source.

BACKGROUND OF THE INVENTION

Gas fired fireplaces are well known in the art. The available art is generally focused on providing means for cooking, either indoors or outdoors. The prior art provides devices that a user can use to enhance or augment an existing gas barbecue or to provide a "stand alone" cooking device. Other devices provide portable wood burning firepits.

Representative of the art is:

U.S. Pat. No. 5,413,087 (1995) to Jean discloses a gas burner mounted in the base of a surrounding bowl with an encircling open wire stand for a cooking utensil.

U.S. Pat. No. 5,203,317 (1993) to James discloses an auxiliary burner unit for mounting on a shelf of a barbecue grill cart or the like.

U.S. Pat. No. 5,094,223 (1992) to Gonzalez discloses a portable wood-burning fire pit apparatus which includes a fire bowl base, a cylindrical wood receiving chamber, a pair of separately controlled gas rings encircling the chamber, a propane gas tank releasably connected to the apparatus and gas rings via a flexible hose and manual quick-release coupling.

U.S. Pat. No. 4,903,683 (1990) to Larsen et al. discloses a system which includes a method and apparatus which facilitates the use of Dutch ovens combined with a charcoal heating source in outdoor cooking.

U.S. Pat. No. 4,788,962 (1988) to Mashburn et al. discloses a barbecue apparatus having its components coaxially disposed on a flanged base supported from a cantilevered arm anchored to a support tube or the like.

U.S. Pat. No. 4,705,020 (1987) to Hahn discloses an improved gas cooker of the type having a housing, a burner supported in the housing, and a fixture for supplying gas to the burner.

U.S. Pat. No. 4,553,524 (1985) to Wheat et al. discloses a portable, compact, gas-fired cooking and barbecuing device for frying and boiling food in conventional cooking utensils or barbecuing food when a barbecuing attachment is utilized.

U.S. Pat. No. 4,108,142 (1978) to Barson et al. discloses a portable barbecue having demountable components including a support structure, a bas burner, a flat or domed hot plate above the burner mounted on the support structure, the hot plate having a plurality of peripheral apertures draining cooking liquids from the hot plate into an annular receptacle therebeneath.

U.S. Pat. No. 3,410,261 (1968) to Cooper et al. discloses a charcoal grilling apparatus consisting of a container for holding heated fuel with a grill supported thereover and support means extending below the container which includes an ignition device in the form of a canister of flammable gas.

What is needed is a portable fireplace that can be used in lieu of a natural wood fire in a firepit. What is needed is a portable fireplace having a windscreen that can be used in windy conditions. What is needed is a portable fireplace that can use a wide range of available fuel gas sources. What is needed is a portable fireplace that has a fluid containing burner to provide the visual effect of flames emerging from a fluid surface. What is needed is a portable fireplace that has a quick-connect to a fuel gas source. What is needed is a portable fireplace that provides a sparkless flame. The present invention meets these needs.

SUMMARY OF THE INVENTION

The primary aspect of the invention is to provide a portable fireplace having a planar base.

Another aspect of the invention is to provide a portable fireplace using gas as a fuel source.

Another aspect of the invention is to provide a portable fireplace having a plurality of gas orifices.

Another aspect of the invention is to provide a portable fireplace having a windscreen.

Another aspect of the invention is to provide a portable fireplace having a safety valve.

Another aspect of the invention is to provide a portable fireplace having a quick-connect to a fuel source.

Another aspect of the invention is to provide a portable fireplace having a stand and carrying case.

Another aspect of the invention is to provide a portable fireplace providing a smokeless flame.

Another aspect of the invention is to provide a portable fireplace providing a sparkless flame.

Another aspect of the invention is to provide a portable fireplace providing a fluid filled burner.

Another aspect of the invention is to provide a portable fireplace providing a high flame.

Another aspect of the invention is to provide a portable fireplace providing a large spacing between orifices.

Another aspect of the invention is to provide a portable fireplace having a cover that is used as a stand.

Other aspects of this invention will appear from the following description and appended claims, reference being made to the accompanying drawings forming a part of this specification wherein like reference characters designate corresponding parts in the several views.

The invention comprises a portable open flame fireplace. The invention has a planar base with a plurality of gas orifices. The base is of any desired shape. The gas is directed through gas channels in the base to each orifice, where it emerges and ignites. The base may be enclosed with a watertight windscreen. The windscreen encloses the flame. The windscreen may also contain a non-combustible fluid such as water, which allows the illusion of flames emerging from a free water surface. The invention further comprises a detachable portable fuel source, such as a propane gas bottle or a recreational vehicle fuel system. The invention also has a removable cover for storage and transport.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
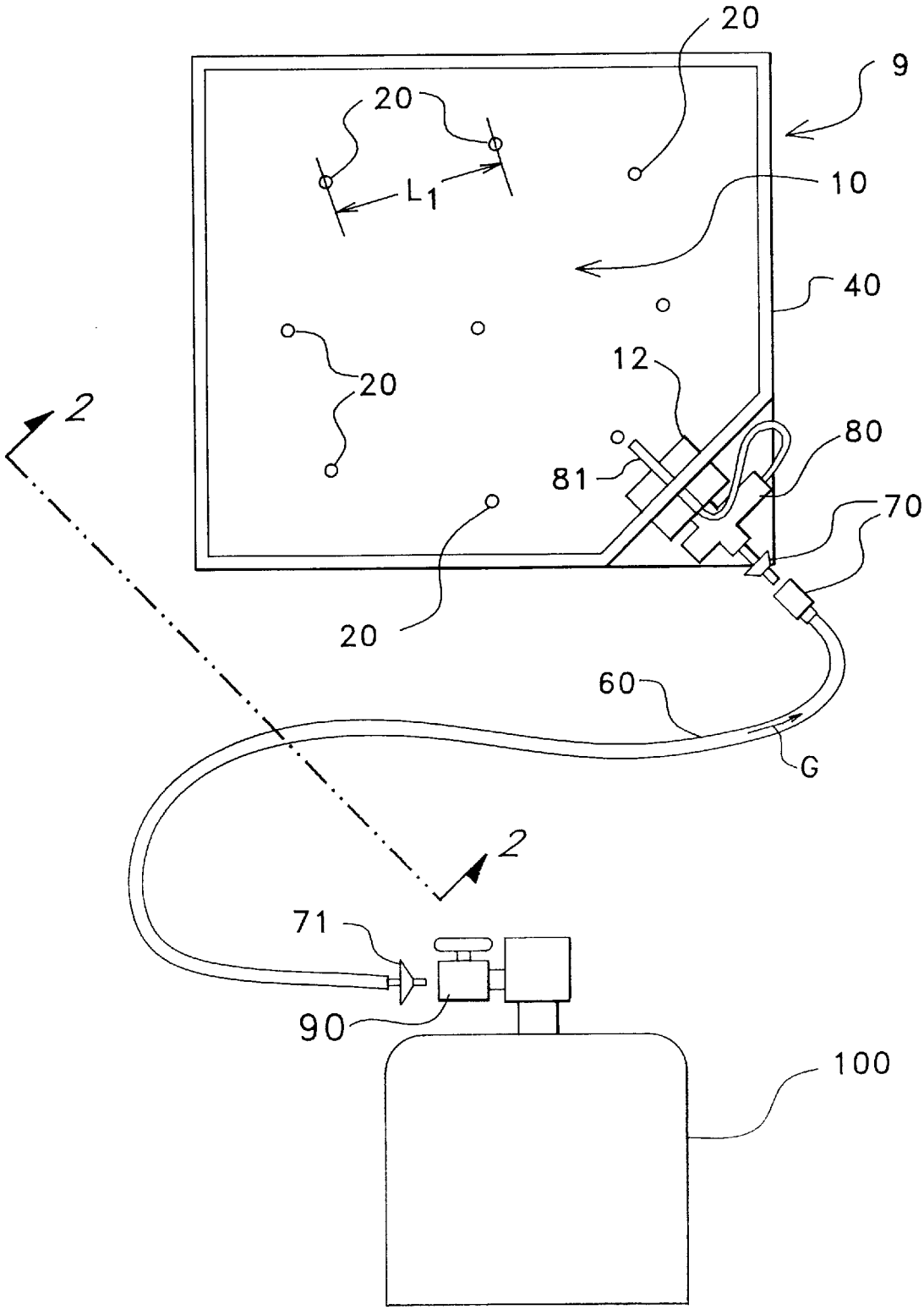
FIG. 1 is a schematic view of the preferred embodiment.

FIG. 1 is a schematic view of the preferred embodiment. Fireplace 9 comprises planar base 10. Base 10 comprises a plurality of gas orifices 20. Each orifice 20 may be fabricated in base 10 or comprise any one of those threaded orifices available in the art. Orifices 20 range in size from 1/16" to 1" in diameter. Base 10 comprises any solid heat resistant material such as metal, clay, plastic, wood, concrete, stone, and ceramic. Windscreen 40 encircles a perimeter of base 10, thereby preventing strong winds from affecting the flame. Windscreen 40 may comprise any flame resistant material identified in the list above for the base 10. Although shown in the preferred embodiment as having a rectangular shape, base 10 may have any shape including round, oval or any other form. Base 10 comprises safety valve 80 and quick-connect 70. Safety valve 80 is connected to base 10 by block 12. Safety valve 80, having probe 81, is known in the art and will terminate the fuel gas flow in the event of loss of flame on the fireplace 9. Gas hose 60 is connected to safety valve 80 by quick connect 70. Quick-connect 70, known in the art, allows gas hose 60 to be quickly attached to the invention. Hose 60 is connected to valve 90 by quick connect 71, also known in the art. Valve 90, used for fuel gas flow control and shut-off, is connected to fuel tank 100. Fuel tank 100 may contain any suitable fuel gas, such as propane or butane. Fuel gas G is fed to safety valve 80 through hose 60. It flows through a channel (shown in FIG. 2) in block 12 to enter gas channels, 11. It flows through gas channels 11, (not shown), to flow from gas orifices 20. This results in a vertical flame shape as shown in FIG. 3. Base 10 may be fabricated from one single piece of material or laminated together from a plurality of pieces. Orifices 20 may be set on a spacing, L1, having a range of not less than 1 inch and not greater than 2 feet. It is possible to add rocks (not shown) to the base in order to enhance the visual effect.

Figure 2:
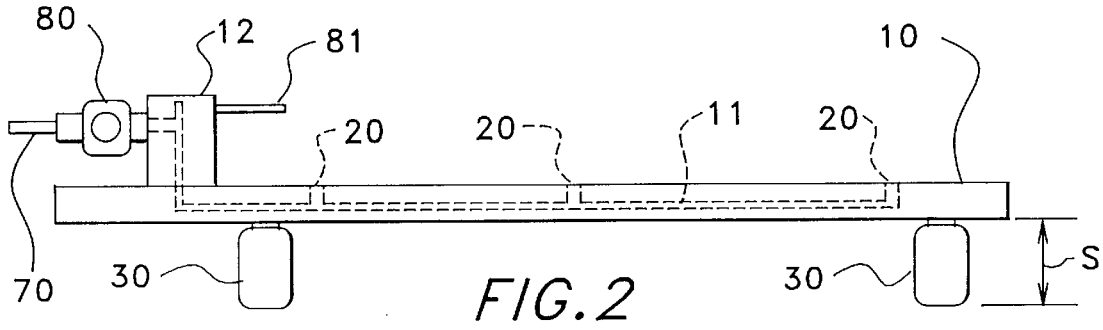
FIG. 2 is a side elevation view of the preferred embodiment along line A—A in FIG. 1.
Figure 3:
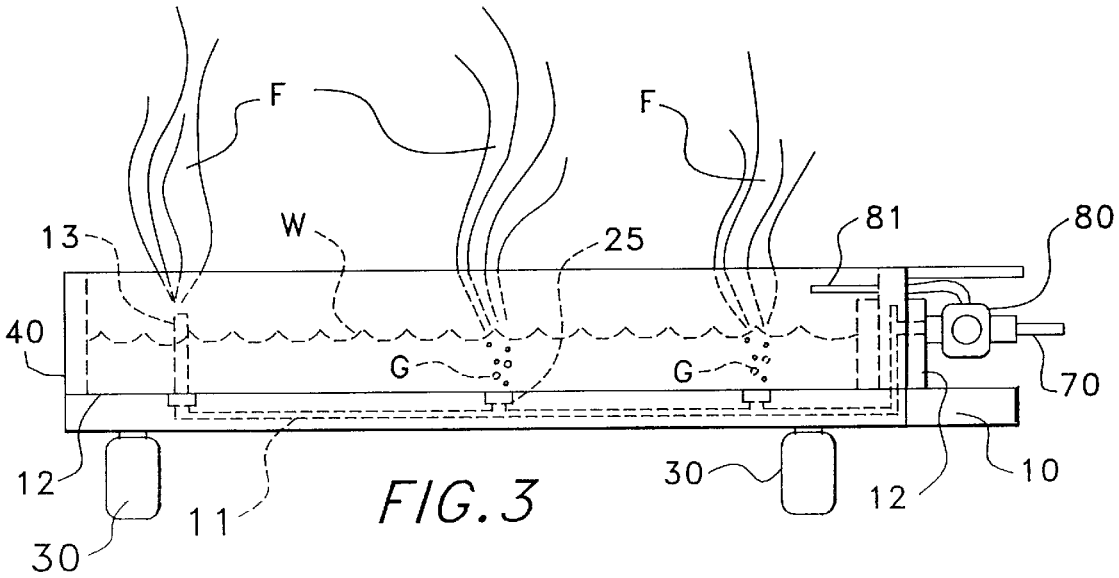
FIG. 3 is a side elevation view of the preferred embodiment.

FIG. 2 is a side elevation view of the preferred embodiment along line A—A in FIG. 1. Quick-connect 70 and safety valve 80 are connected to base 10 at block 12. Legs 30 support base 10 to keep base 10 at some spacing, S, above the ground. Legs 30 are adjustable to allow use of the invention on uneven surfaces. The legs allow the base 10 to be clear of any combustible material that may be on the ground or surface of use. Gas channel 11 runs from block 12 to each gas orifice 20. FIG. 2 depicts an alternate arrangement wherein the windscreen 40 described in FIG. 1 is not used. This results in the pleasing visual effect of a plurality of flames extending above a planar surface.

FIG. 3 is a side elevation view of the preferred embodiment. Windscreen 40 encloses base 10 as well as the flames F. The seams between the windscreen 40 and base 10 are watertight 12 and therefore, can contain water W. In operation, the gas flows from each orifice 20 and up through the water W. The fluid W may also comprise any noncombustible fluid. Once the gas emerges above the water, the gas is ignited by match or spark igniter, each known in the art. This gives the enjoyable visual effect of a gas flame burning in a sustained manner above the surface of the fluid including the reflectance of the flames on the surface of the fluid. When used with fluid, the orifices 20 further comprise a diaphragm valve or check valve 25, known in the art, to prevent water or fluid from entering into gas channel 11. The gas may be further directed to the fluid surface by flowing through a pipe 13 to the proper elevation at or near the fluid surface. The diameter of pipe 13 equates to those identified for the gas orifices 20 in FIG. 1.

Figure 4:
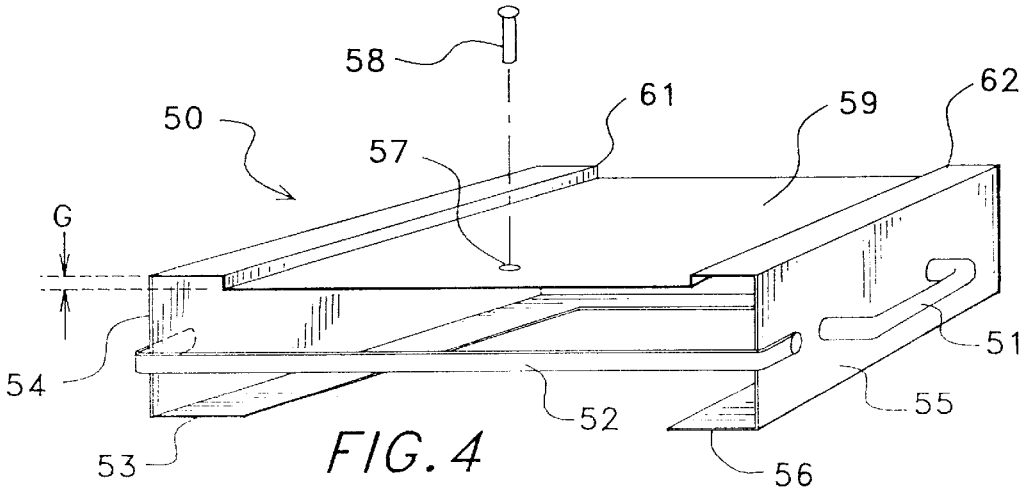
FIG. 4 is a perspective view of a cover for the preferred embodiment.

FIG. 4 is a perspective view of a cover for the preferred embodiment. Cover 50 comprises opposing sides 54 and 55. Each opposing side 54 and 55 is attached to top 59 at right angles. Lip 56 and lip 53 are each attached respectively to side 55 and 54. Each lip cooperates with an outer edge of base 10. Handle 51 is used to carry the invention. Cover 50 slides over base 10 and windscreen 40 so as to enclose the invention when not in use. Strap 52 allows cover 50 be secured to the invention. Hole 57 cooperates with pin 58. Pin 58 latches an exterior side of windscreen 40 so as to lock the cover 50 in place over the invention. Cover 50 may be used as a stand for the invention during use. Cover 50 also comprises ledges 61 and 62, which oppose each other on the top of the cover 50. Ledges 61 and 62 allow the cover to have a gap G between the underside of base 10 and the cover 50 when the cover 50 is being used as a stand for the invention.

Figure 5:
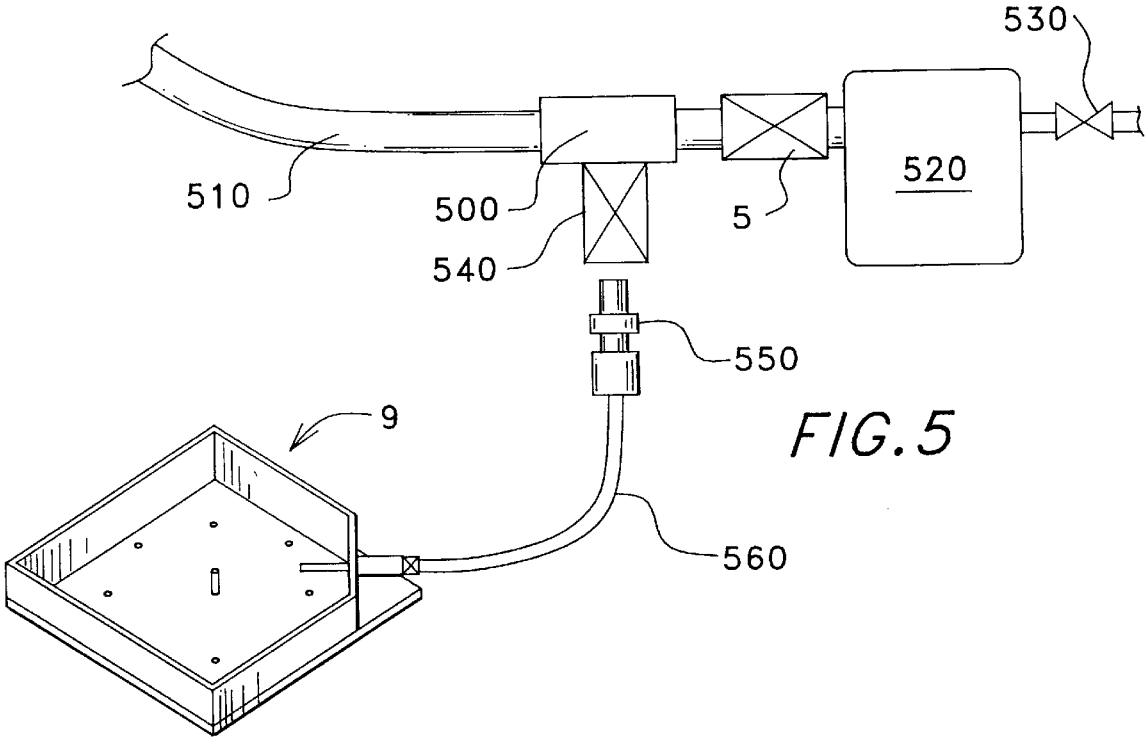
FIG. 5 is a schematic diagram of the preferred system.

FIG. 5 is a schematic diagram of the system. Fuel tank 520 is contained within any machine or vehicle, for example, a recreational vehicle. Fuel line 510 extends from fuel tank 520 to the equipment within the recreational vehicle and as such is generally an integral part of the vehicle. Tee 500 is installed in line 510. Tee 500 is connected to valve 540 and to quick connect 550, known in the art. Line 560, connected to quick connect 550, is of sufficient length to allow the invention 9, as described in FIG. 1, to be connected to hose 560, and thereby fuel tank 520, while allowing a user to position the invention in a safe place for use. Hose 560 may be of any length desired by a user. Fuel tank 520 is serviced by fuel filler 530. Fuel tank 520 may be of any size readily available in the art. Valve 540 may be of any type appropriate for fuel gas service readily available in the art.

Figure 6:
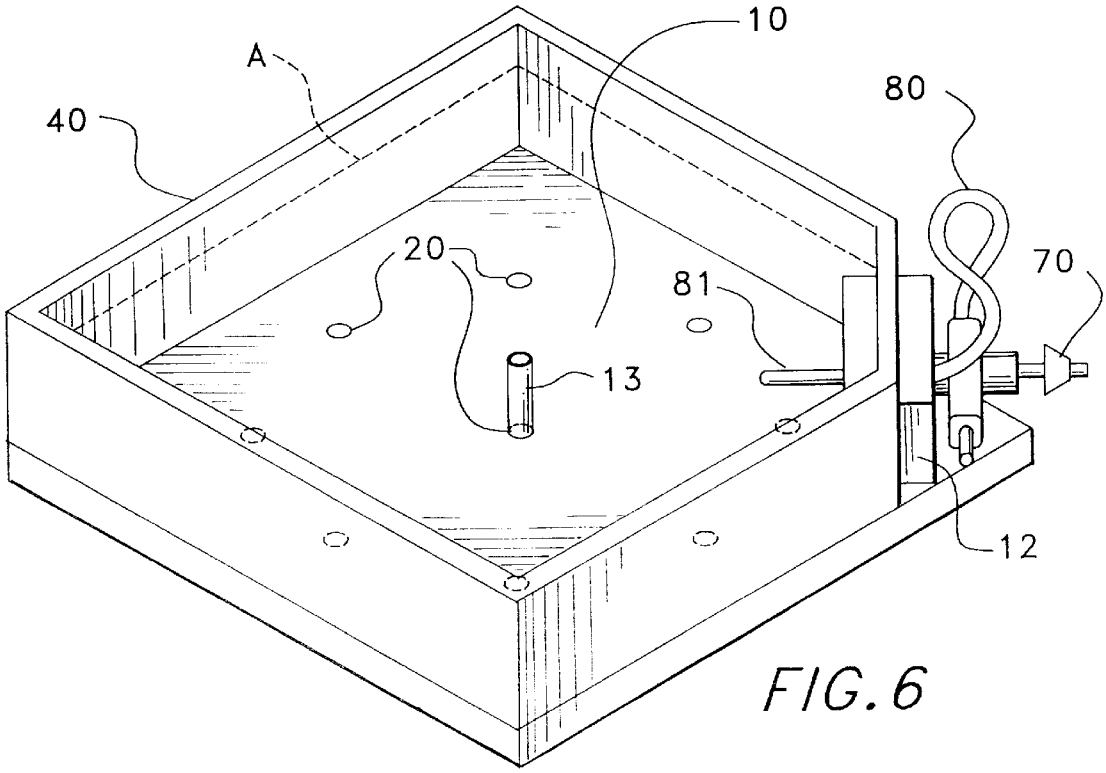
FIG. 6 is a top perspective view of the preferred embodiment.

FIG. 6 is a top perspective view of the preferred embodiment. Windscreen 40 is shown about a perimeter of base 10. Line "A" depicts an elevation of the surface of a fluid as described in FIG. 3. In an alternate embodiment wherein fluid is used, pipe 13 extends from orifice 20. Each orifice 20 may have a pipe 13, or a user may use pipe 13 on less than all orifices 20, in order to create the desired visual effect. Pipe 13 extends to approximately elevation "A", either above or below the surface of the fluid. In the fluid filled embodiment, safety valve probe 81 extends above the surface of the fluid to detect a loss of flame condition, if such occurs.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A portable fireplace comprising:

a fuel source;

a fuel pipe connected to said fuel source and having a plurality of orifices facing vertically with a minimal spacing of one inch;

said fuel pipe mounted in a stand suitable to place on the ground;

a windscreen mounted to the stand, wherein the windscreen protects flames issuing from said orifices from being extinguished due to high air flow over said orifices, and the flames provide a visual effect of a fireplace; and a combination cover and stand having a planar surface and having first and second opposing sides connected to said planar surface at opposing edges and normal to said planar surface sized to cover said portable fireplace when not in use, and support said portable fireplace when in use.

2. A portable fireplace comprising:

a base having a first surface and having a plurality of orifices in said first surface, each of said orifices connected by a gas channel extending through said base to a connecting block;

a fuel gas port connected to said connecting block;

a windscreen having a plurality of surfaces normal to said base;

said plurality of surfaces encircling said first surface;

a spacing between said orifices ranging from 1" to 2 feet;

a watertight seal between said windscreen and said first surface;

a noncombustible fluid contained within said windscreen over said first surface, whereby a gas flows from said orifices through said fluid to burn above a surface of said fluid; wherein each of said orifices further comprises:

a pipe having a length substantially equal to a height of a fluid surface above said first surface;

said pipe having an orientation substantially normal to said first surface;

wherein said base comprises a non-combustible material;

a plurality of legs attached to a bottom surface of said planar base;

said bottom surface opposite to said first surface;

a cover having a planar surface and having first and second opposing sides connected to said planar surface at opposing edges and normal to said planar surface; said first and second opposing sides each having a lip; each lip extending toward each other; each lip normal to each of said first and second opposing sides; and each lip cooperating with a lower portion of said base, whereby said cover is slidingly connected to said burner.

3. A portable fireplace comprising:

a portable base having a first surface and having a plurality of orifices in said first surface, each of said orifices connected by a gas channel extending through said base to a connecting block;

a portable fuel gas source connected to said connecting block;

a windscreen having a plurality of surfaces normal to said base; said plurality of surfaces encircling said first surface;

a spacing between said orifices ranging from 1" to 2 feet, thereby providing a pleasing visual effect of a plurality of flames rising above the windscreen;

a support leg to provide a gap between a support surface and the base; and wherein said windscreen comprises a watertight seal between said windscreen and said first surface.

4. The portable fireplace as in claim 1 further comprising:

a safety valve connected to said block.

5. The portable fireplace as in claim 4 further comprising:

a quick connect attached to said safety valve.

6. The portable fireplace as in claim 5, wherein each of said orifices further comprise a diameter of 1/16" to 1".

7. The portable fireplace as in claim 1 further comprising:

a noncombustible fluid contained within said windscreen over said first surface whereby a gas flows from said orifices through said fluid to burn above a surface of said fluid.

8. The portable fireplace as in claim 7, wherein each of said orifices further comprise:

a pipe having a length substantially equal to a height of a fluid surface above said first surface; and said pipe having an orientation substantially normal to said first surface.

9. The portable fireplace as in claim 8, wherein said base comprises a non-combustible material.

10. The portable fireplace as in claim 1 further comprising:

a plurality of support legs attached to a bottom surface of said planar base; said bottom surface opposite to said first surface; and each of said legs being adjustable in length.

11. The portable fireplace as in claim 10, wherein said portable fuel gas source comprises:

a hose having a connector;

a valve connected to said hose and connected to a fuel gas source.

12. The portable fireplace as in claim 11 further comprising:

a cover having a planar surface and having first and second opposing sides connected to said planar surface at opposing edges and normal to said planar surface; said first and second opposing sides each having a lip; each lip extending toward each other; and each lip normal to each of said first and second opposing side; and each lip cooperating with a lower portion of said base whereby said cover is slidingly connected to said burner.

13. A portable fireplace comprising:

a fuel port;

a fuel pipe connected to said fuel port and having a plurality of orifices facing vertically with a minimal spacing of one inch;

said fuel pipe mounted in a portable stand suitable to place on a ground surface;

a windscreen mounted to the stand, wherein the windscreen protects flames issuing from said orifices from being extinguished due to high air flow over said orifices and the flames provide a visual effect of a fireplace; and said stand having a support leg to maintain a gap between the stand and the ground surface; and a waterproof housing in the stand to permit the orifices to burn through a non-combustible fluid contained in the waterproof housing.

14. The portable fireplace as in claim 13, wherein the waterproof housing comprises the windscreen attached to a base serving as a stand.

15. The portable fireplace as in claim 13, further comprising solid materials supported in the base to enhance the visual effect.

* * * * *